US012310423B2

(12) United States Patent
Benike et al.

(10) Patent No.: US 12,310,423 B2
(45) Date of Patent: May 27, 2025

(54) BIB AND UTENSIL KIT

(71) Applicant: Busy Baby LLC, Oronoco, MN (US)

(72) Inventors: Beth Benike, Oronoco, MN (US); Alex Coffey, West Valley City, UT (US); Luke Gonos, West Valley City, UT (US); Aaron Nelson, West Valley City, UT (US); Eric Fynbo, Savage, MN (US)

(73) Assignee: Busy Baby LLC, Oronoco, MN (US)

( * ) Notice: Subject to any disclaimer, the term of this patent is extended or adjusted under 35 U.S.C. 154(b) by 0 days.

(21) Appl. No.: 18/116,287

(22) Filed: Mar. 1, 2023

(65) Prior Publication Data

US 2024/0099397 A1 Mar. 28, 2024

Related U.S. Application Data

(63) Continuation-in-part of application No. 29/854,381, filed on Sep. 23, 2022, now Pat. No. Des. 1,054,801, and a continuation-in-part of application No. 29/854,395, filed on Sep. 23, 2022.

(60) Provisional application No. 63/409,591, filed on Sep. 23, 2022.

(51) Int. Cl.
*A41B 13/10* (2006.01)

(52) U.S. Cl.
CPC ..... *A41B 13/103* (2013.01)

(58) Field of Classification Search
CPC ..... A41B 13/10; A41B 13/103; A41D 13/04; A47G 21/02; A47G 21/04; A47J 43/28
See application file for complete search history.

(56) References Cited

U.S. PATENT DOCUMENTS

| | | | | |
|---|---|---|---|---|
| 7,444,685 | B2 | 11/2008 | Rose | |
| 9,125,438 | B2 | 9/2015 | Adler | |
| 10,674,850 | B2 * | 6/2020 | Fynbo | A47G 23/0303 |
| 10,695,268 | B2 | 6/2020 | Holk | |
| 11,641,887 | B2 * | 5/2023 | D'Amato-Friedman | A41B 13/103 2/49.2 |
| 2004/0194322 | A1 * | 10/2004 | Bullard | A47G 21/02 30/286 |

(Continued)

FOREIGN PATENT DOCUMENTS

| | | |
|---|---|---|
| CN | 110099579 | 8/2019 |
| EP | 2586420 | 5/2013 |
| GB | 2434968 | 8/2007 |

(Continued)

OTHER PUBLICATIONS

Google search "plastic lobster clasp" (Year: 2024).*

(Continued)

*Primary Examiner* — Sally Haden
(74) *Attorney, Agent, or Firm* — Headland Law & Strategy; Matthew J. Smyth

(57) ABSTRACT

In some implementations, a kit includes a bib having a protective surface and a bib-coupling point; at least one eating utensil having a working end and a retention end, where the retention end includes a utensil-coupling point; and a tether having a first anchor end having a first coupling point that is configured to releasably couple to the bib-coupling point and a second anchor end having a second coupling point that is configured to releasably couple to the utensil-coupling point.

13 Claims, 6 Drawing Sheets

(56) References Cited

U.S. PATENT DOCUMENTS

| | | | | |
|---|---|---|---|---|
| 2014/0299608 | A1* | 10/2014 | Melo | A47G 11/004 220/574 |
| 2020/0138120 | A1 | 5/2020 | Brazdo | |

FOREIGN PATENT DOCUMENTS

| | | |
|---|---|---|
| KR | 200416517 | 5/2006 |
| WO | 2002078495 | 10/2002 |
| WO | 2018025073 | 2/2018 |
| WO | 2022150050 | 7/2022 |

OTHER PUBLICATIONS

Bumkins Dipping, Feeding, Baby Led Weaning Training Spoon, 7 pages, available at www.amazon.com/Bumkins-Dipping-Feeding-Weaning-Training/dp/B08CV3VVBP3, retrieved Sep. 12, 2020.
Busy Baby, It's almost here !!! The Busy Baby Teething Spoon is going to be a game changer . . . Facebook, Jan. 4, 2021, https://www.facebook.com/busybabymaUphotos/a.338051193392138/986426565221261/, retrieved Feb. 18, 2021.
EZtotz, Baby Utensils, 2 pages , available at: https://eztotz.com/collections/baby-led-weaning-utensils, retrieved Dec. 21, 2020.
Munchkin, Toddler, Utensils, retrieved on Dec. 21, 2020, pp. 7, available at: https://www.munchkin.com/toddler/utensils/infant-spoons.html.
Nuby, Dipeez Spoons, Tableware, retrieved on Jan. 6, 2021, pp. 3, https://www.nuby.com/za/dipeez-spoons/.
Numnum, Our Products, retrieved on Dec. 21, 2020, pp. 3, available at: https://numnumbaby.us/pages/products.

* cited by examiner

BIB AND UTENSIL KIT

CROSS-REFERENCE TO RELATED APPLICATIONS

This application claims priority to U.S. Provisional Application Ser. No. 63/409,591, titled "Bib and Utensils Kit," filed on Sep. 23, 2022; U.S. Design application Ser. No. 29/854,395, titled "Bib," filed on Sep. 23, 2022; and U.S. Design application Ser. No. 29/854,381, titled "Utensils," filed on Sep. 23, 2022. This application incorporates the entire contents of the foregoing applications herein by reference.

TECHNICAL FIELD

Various implementations relate generally to a bib and utensil kit.

BACKGROUND

As toddlers are learning to use utensils (or other individuals who may lack certain physical dexterity), a system may be advantageous for preventing such utensils from falling or otherwise moving beyond the reach of the user.

SUMMARY

Described herein is a kit that includes a bib, an eating utensil and a tether for releasably coupling the eating utensil to the bib. In some implementations, a kit may include a bib, at least one eating utensil and a tether. The bib may have a protective surface, a basin disposed at a bottom end of the protective surface, and one or more bib apertures each characterized by a bib-aperture diameter. The eating utensil may have a working end, a retention end, and a handle disposed between the working end and the retention end. The retention end may include a utensil-retention aperture characterized by a retention-aperture diameter. The tether may include a first anchor end with a first retention terminus and a second anchor end with a second retention terminus. Each of the first and second retention termini may be characterized by a retention-terminus diameter that is greater than either the bib-aperture diameter or the utensil-retention-aperture diameter. The bib-aperture and first retention terminus may be configured to enable the first retention terminus to be compressed and manipulated into and through the bib-aperture to releasably secure the tether to the bib. The utensil-retention aperture and second retention terminus may be configured to enable the second retention terminus to be compressed and manipulated into and through the utensil-retention aperture to releasably secure the utensil to the tether.

At least one of the bib, the tether and the retention end may comprise a food-grade silicone. The basin may be configured to retain water and food items. At least one of the one or more bib apertures may be disposed on a lip of the basin. The bib may further include a closure means for securing the bib around a neck of a wearer.

The bib may include a first cooperating wing with one or more buttons and a second cooperating wing with one or more buttonholes; and each of the one or more buttons may be configured to releasably engage one of the one or more buttonholes to facilitate securing of the bib around a neck of a wearer.

The tether may further include an elastic section between the first anchor end and second anchor end that includes a plurality of stretchable zigzags. The handle may include raised ridges configured to facilitate gripping of the handle. The working end may include at least one of protrusions and ridges configured to stimulate gums, tongue or mouth of a user.

In some implementations, a kit includes a bib having a protective surface and a bib-coupling point; at least one eating utensil having a working end and a retention end, where the retention end includes a utensil-coupling point; and a tether having a first anchor end having a first coupling point that is configured to releasably couple to the bib-coupling point, and a second anchor end having a second coupling point that is configured to releasably couple to the utensil-coupling point.

The bib may include a basin disposed at a bottom end of the protective surface. The bib-coupling point may be disposed on a lip of the basin. The at least one eating utensil may include a fork, a spoon and a knife.

The bib-coupling point may comprise a bib aperture that is characterized by a bib-aperture diameter; and the utensil-coupling point may comprise a utensil aperture characterized by a utensil-aperture diameter.

In some implementations, the first coupling point may comprise a first retention terminus, and the second coupling point may comprise a second retention terminus, where each of the first retention terminus and second retention terminus are characterized by a retention-terminus diameter that is greater than either the bib-aperture diameter or the utensil-aperture diameter. The bib aperture and first retention terminus may be configured to enable the first retention terminus to be compressed and manipulated into and through the bib aperture to releasably secure the tether to the bib, and the utensil-retention aperture and second retention terminus may be configured to enable the second retention terminus to be compressed and manipulated into and through the utensil-retention aperture to releasably secure the eating utensil to the tether.

In other implementations, at least one of the first coupling point and second coupling point includes one of a carabiner, a locking carabiner, a spring-release carabiner, a ring, an expandable ring, a quick-release clip, a hook or a clasp.

In still other implementations, the bib-coupling point may comprise a first magnet, the utensil-coupling point may comprise a second magnet, the first anchor end may comprise a third magnet that is configured to releasably couple to the first magnet, and the second anchor end may comprise a fourth magnet that is configured to releasably couple to the second magnet.

In some implementations, a kit includes (i) a bib configured to protect the front torso of a wearer from drool or food or liquid spills, and the bib may have a front surface and a bib-coupling point; (ii) at least one eating utensil having a working end and a retention end, where the retention end includes a utensil-coupling point; and (iii) a tether that includes a first anchor end having a means for releasably coupling to the bib-coupling point and a second anchor end having a means for releasably coupling to the utensil-coupling point.

The at least one eating utensil may include a fork, a spoon and a knife. The bib may further include a basin disposed at a bottom end of the bib.

DETAILED DESCRIPTION

Figure 1A:
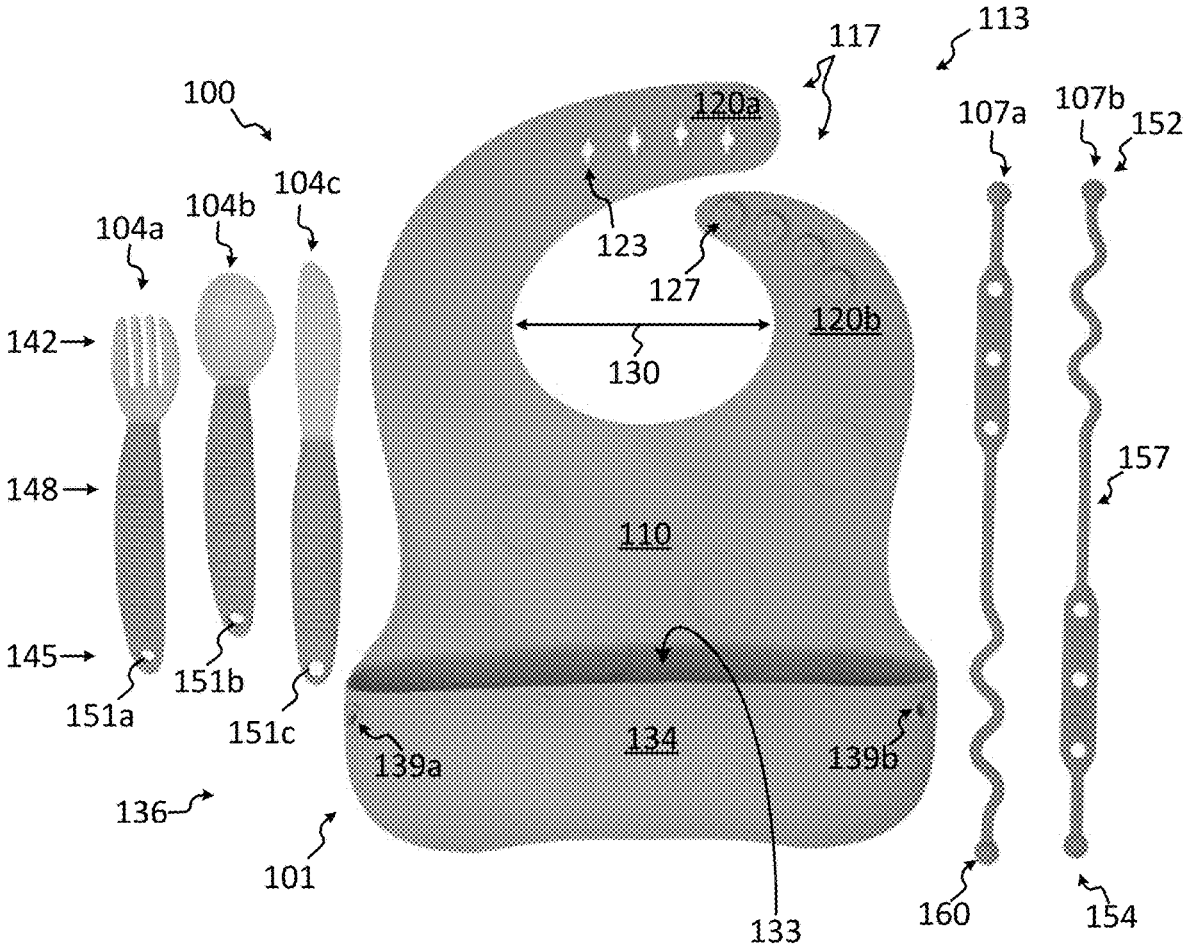
FIG. 1A illustrates an exemplary kit that includes a bib, eating utensils and tethers.

FIG. 1A illustrates an exemplary kit 100 that includes a bib 101; eating utensils 104*a*, 104*b* and 104*c*; and tethers 107*a* and 107*b* for coupling one or more of the eating utensils 104*a*, 104*b* and 104*c* to the bib 101.

As shown, the bib 101 includes a protective surface 110. In some implementations, the protective surface 110 is configured to protect the front torso of a wearer from food and liquid spills. The protective surface 110 may comprise a coated fabric, a plastic, a silicone, a rubber, or another suitable material. The material may be flexible, easily washable, and it may have inherent antibacterial properties, or it may be coated or treated to have such properties.

In some implementations, the bib 101 is molded (e.g., from a food-grade silicone or plastic), and the bib 101 may have a mass that tends to keep it positioned in place on a wearer. A surface finish may also be applied to a back surface of the bib 101 to increase friction between said back surface and a front clothing item of the wearer—to also help keep the bib 101 securely positioned in place.

In some implementations, such as the one shown in FIG. 1A, the top end 113 of the protective surface 110 includes a closure 117 configured to secure the bib 101 around the neck of a wearer. For example, in some implementations, the closure 117 includes cooperating wings 120*a* and 120*b*, where the wing 120*a* includes a plurality of slots or buttonholes (including buttonhole 123), and the wing 120*b* includes a plurality of raised buttons (including button 127). To secure the two wings 120*a* and 120*b* together around a wearer's neck, one of the buttons 127 may be engaged with one of the buttonholes. In implementations such as the one shown—with a plurality of buttons and buttonholes—it may be possible to adjust the size of the opening 130 formed by the wings 120*a* and 120*b*, to adjust the fit of the bib 101 to wearers having various neck sizes, or for varying levels of security or comfort.

In other implementations, other closure means may be employed for securing the bib 101 to a wearer. For example, a bib may include laces that can be tied together behind the neck of a wearer; a bib may include a releasable magnetic coupling; or, a bib may include other releasable closure mechanisms (e.g., clasps, links, hooks, etc.).

In some implementations, the bib 101 includes a pocket, or basin 133, disposed at a bottom end 136 of the bib 101. The basin 133 may be configured as a vessel that is closed at the bottom but open at the top, such that food, liquid or drool that falls from the wearer or runs down the protective surface 110 is contained within the basin 133. The basin may be watertight.

Figure 1B:
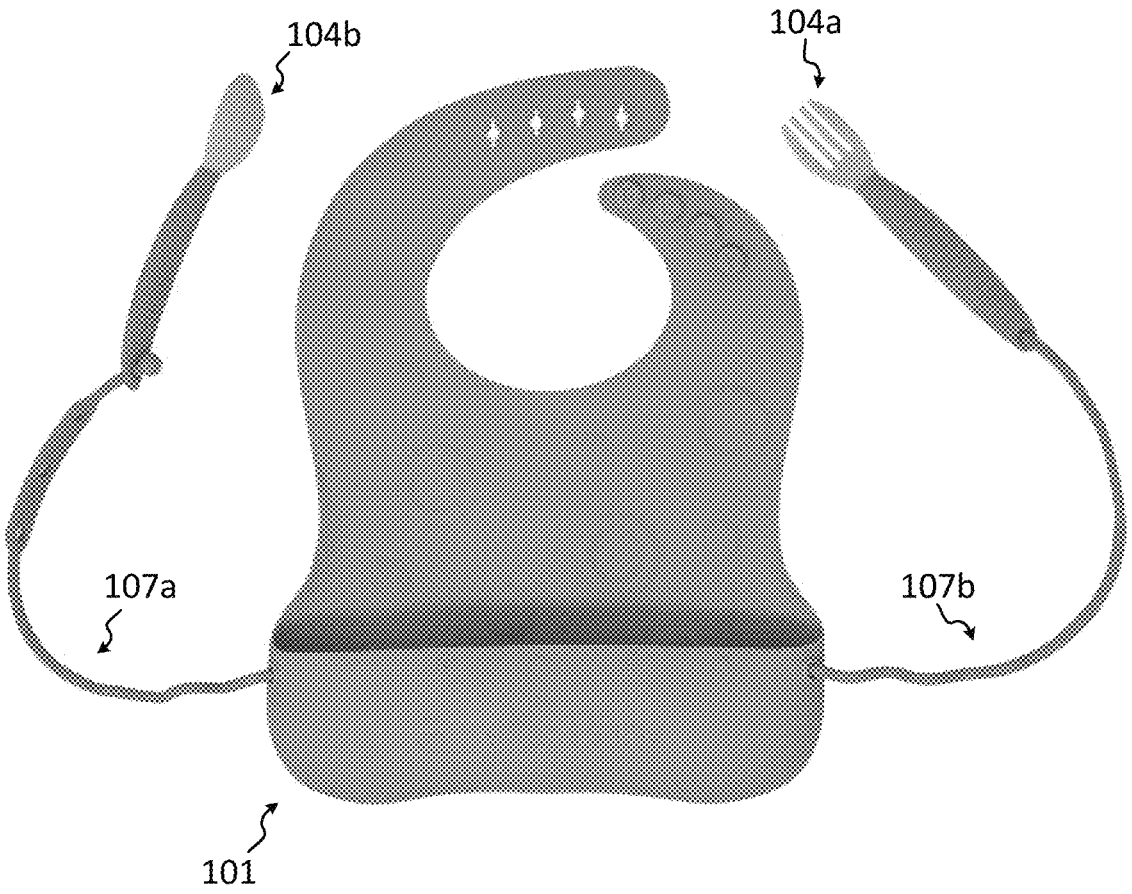
FIG. 1B illustrates a spoon and fork tethered to a bib.
Figure 1C:
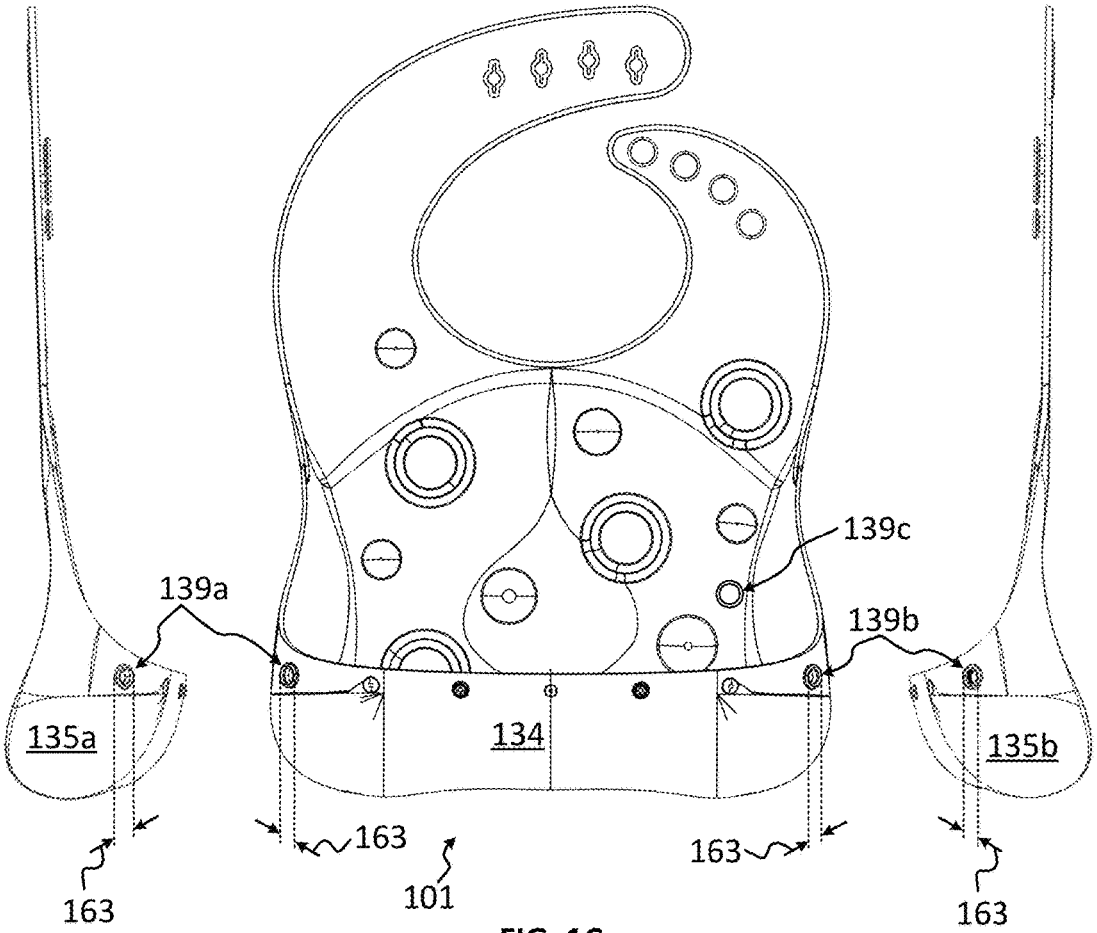
FIG. 1C illustrates additional detail of the bib.

In some implementations, the basin 133 is formed by the protective surface 110 in the back, a front wall 134 in the front, and side walls 135*a* and 135*b* on the side (see FIG. 1C). In implementations in which the bib 101 is molded from a material such as silicone or food-grade silicone, the walls 134, 135*a* and 135*b* may be portions of a smoothly contoured surface that joins the protective surface 110 in the back. In other implementations, each of the walls 134 and 135*a* and 135*b* may be more delineated from each other, forming a more boxy structure than that illustrated. In still other implementations, the basin 133 may be completed omitted from the bib 101.

When present, the basin 133 may include one or more bib apertures 139*a* and 139*b*. In some implementations, the bib apertures 139*a* and 139*b* are circular and are characterized by a bib-aperture diameter 163 (see FIG. 1C). As shown in one implementation, the bib apertures 139*a* and 139*b* may be disposed near the top of the basin 133, to maximize the liquid-carrying capacity of the basin 133. In other implementations, the basin 133 may be omitted; and one or more bib apertures may be disposed at another location on the bib 101 (e.g., at a side edge of the bib, in the position of bib aperture 139*c* in FIG. 1C).

As shown, the kit 100 includes at least one eating utensil; and in some implementations, a fork 104*a*, spoon 104*b* and knife 104*c* are provided. Each of the eating utensils may include a working end 142, a retention end 145, and a handle 148 disposed between the working end 142 and retention end 145. The working end 142 of different eating utensils 104 may perform different functions; but generally, the eating utensils may be configured to retain, process or support food items. For example, the fork 104*a*, spoon 104*b* and knife 104*c* may each be used to cut or mash various food items; the fork 104*a* and spoon 104*b* may be used to retain or support various food items; etc.

In some implementations, as shown, the eating utensils 104*a*, 104*b* and 104*c* include utensil-retention apertures 151*a*, 151*b* and 151*c*, each of which may be characterized by utensil-retention-aperture diameters 166 (see FIG. 1C). Such retention apertures 151*a*-151*c* may provide a means for coupling the eating utensils 104*a*-104*c* to tethers 107*a* and 107*b*, in a manner now described.

Also included in the kit 100, as shown, are tethers 107*a* and 107*b*. Each tether may have a first anchor end 152 and a second anchor end 154, with a middle section 157 between the first anchor end 152 and second anchor end 154. In some implementations, each of the first anchor end 152 and second anchor end 154 includes a retention terminus (e.g., retention terminus 160); and the retention terminus 160 may be configured such that the retention terminus at the first anchor end 152 can be compressed and manipulated into and through one of the bib apertures 139*a* or 139*b* and the retention terminus at the second anchor end 154 can be compressed and manipulated into and through one of the utensil-retention apertures 151*a*, 151*b* or 151*c*—to thereby releasably couple one or more of the eating utensils 104*a*, 104*b* and 104*c* to the bib 101.

FIG. 1B illustrates one implementation in which the spoon 104*b* is coupled to the bib 101 with tether 107*a* and the fork 104*a* is coupled to the bib 101 with tether 107*b*. In such an implementation, a wearer of the bib 101 may have ready access to the tethered eating utensils 104*a* and 104*b*. That is, should the wearer of the bib 101 be grasping, for example, the spoon 104*b*, but then lose her grip on that spoon 104*b*, the wearer need only reach for the tether 107*a* and either follow the tether 107*a* with her hand to the spoon 104*b* or use the tether 107*a* to pull the spoon 104*b* to her hand. In this manner, a wearer of the bib 101, such as a toddler just learning to use eating utensils to feed herself, may avoid the frustration of dropping an eating utensil out of reach. Moreover, the bib 101 may provide protection from food and liquid spills that are common with toddlers just learning to feed themselves.

The exemplary bib and utensil kit 100 illustrated and described herein need not be limited to toddlers. Kits having larger bibs may be employed with older wearers with limited dexterity, coordination or hand strength—such as, for example, seniors or disabled persons. With such wearers, not only do such kits provide a solution for regularly dropped eating utensils, but the bib functions may also protect these wearers from food and liquid spills. In general, exemplary kits such as those described herein may provide a greater level of independence to wearers and a reduced level of frustration that may otherwise come from dropping eating utensils.

Figure 1D:
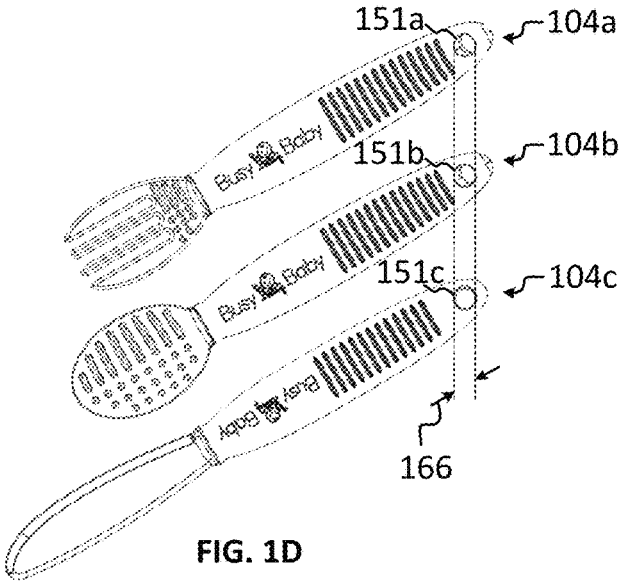
FIG. 1D illustrates additional detail of the eating utensils.
Figure 1E:
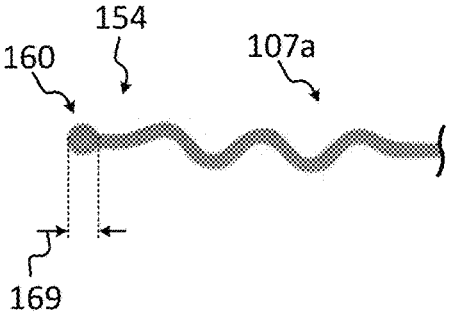
FIG. 1E illustrates additional detail of a tether.

FIGS. 1C, 1D and 1E illustrate additional details that facilitate coupling eating utensils 104*a*, 104*b* and 104*c* to the bib 101, with tethers 107*a* and 107*b*. FIG. 1C illustrates a left-side view, front view and right-side view of the exemplary bib 101. In the implementation shown, the bib apertures 139*a* and 139*b* are characterized by bib-aperture diameters 163. FIG. 1D illustrates eating utensils 104*a*, 104*b* and 104*c*, each with utensil-retention apertures 151*a*, 151*b* and 151*c*, respectively—each of which, as shown, is characterized by a utensil-retention-aperture diameter 166. FIG. 1E illustrates the second end 154 of tether 107*a*, with retention terminus 160—which, as shown, is characterized by a retention-terminus diameter 169.

In some implementations, the retention-terminus diameter 169 is larger than either the bib-aperture diameter 163 or the utensil-retention diameter 166. However, the retention terminus 160 may be made of a material that is both compressible and resilient, such that the retention terminus 160 may be compressed (e.g., squeezed) and manipulated into and through either one of the bib apertures 139*a* or 139*b* or one of the utensil-retention apertures 151*a*, 151*b* or 151*c*. Once the larger retention terminus 160 is manipulated into and through one of the foregoing apertures, its resilient nature may cause the retention terminus 160 to expand and return to its pre-compressed shape and size—thereby forming a compression fit between the tether 107*a* and the bib 101 or the tether 107 and one of the eating utensils 104*a*, 104*b* or 104*c*.

In some implementations, in addition to the retention terminus 160 being compressible, the bib apertures 139*a* and 139*b* and utensil-retention apertures 151*a*, 151*b* and 151*c* may be expandable (e.g., elastic), such that the retention-terminus diameter 169 shrinks and the bib-aperture diameter 163 or utensil-retention-aperture diameter 166 expands as the tether 107*a* or 107*b* is secured.

Figure 2A:
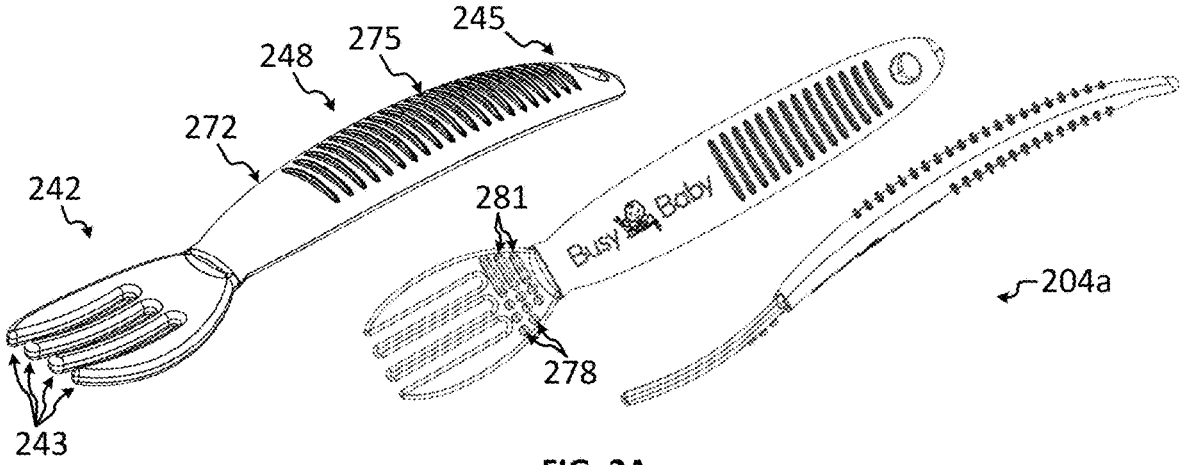
FIGS. 2A-2C illustrate exemplary eating utensils.
Figure 2B:
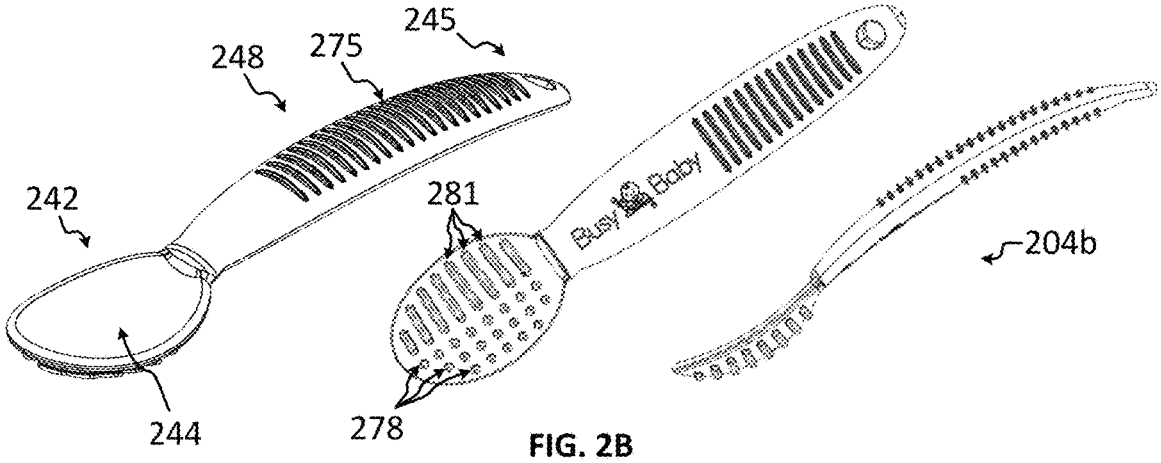
Figure 2C:
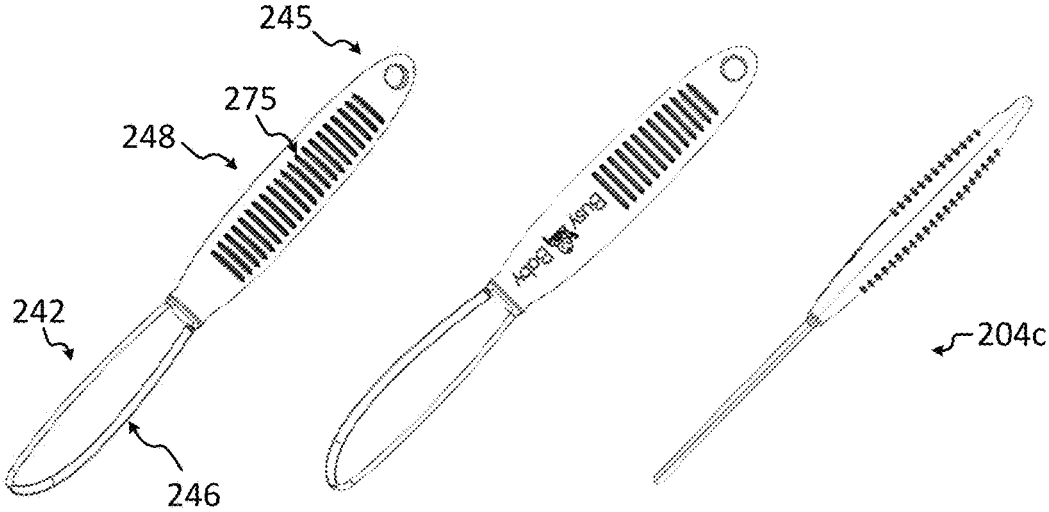

Turning now to FIGS. 2A, 2B and 2C, additional details of exemplary eating utensils are described. FIG. 2A illustrates perspective, top and side views of an exemplary fork 204*a*; FIG. 2B illustrates perspective, top and side views of an exemplary spoon 204*b*; and FIG. 2C illustrates perspective, top and side views of an exemplary knife 204*c*. As shown, each of the exemplary eating utensils 204*a*, 204*b* and 204*c* includes a working end 242, a retention end 245, and a handle 248 disposed between the working end 242 and the retention end 245. The working end 242 of the eating utensils 204*a*, 204*b* or 204*c* generally may facilitate retention, processing or support of food or liquid-food items. For example, tines 243 at the working end 242 of the fork 204*a* may be configured to stab and retain soft foods, such as vegetables or fruit; the bowl 244 at the working end 242 of the spoon 204*b* may be configured to scoop and retain soft foods and liquids, such as applesauce, squash, or milk; the blade 246 at the working end 242 of the knife 204*c* may be configured to cut soft foods, such as potatoes or meats.

Each of the eating utensils 204*a*, 204*b* and 204*c* may be made of a soft and food-safe/teething-safe material such as a food-grade silicone. An outer surface 272 may be soft and/or flexible and may have raised ridges 275 to facilitate gripping. Additional features may be included on a working end of a utensil—such as, for example, protrusions 278 and/or ridges 281 that may stimulate the gums, tongue and/or mouth of a user. U.S. Pat. No. 11,197,584, issued on Dec. 14, 2021, filed on Jan. 8, 2021, and entitled "Teething Spoon," which patent is herein incorporated by reference in its entirety, describes additional features that may be included in or on utensils that can be used with the kit described herein.

Figure 3A:
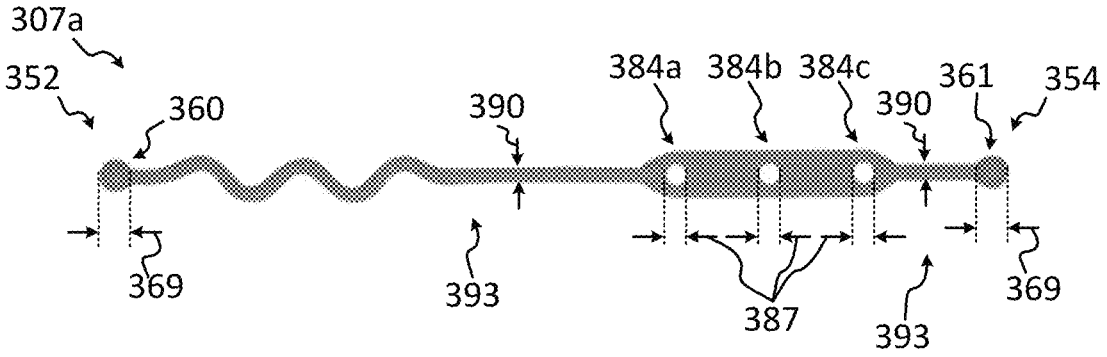
FIGS. 3A-3C illustrate exemplary tethers.
Figure 3B:
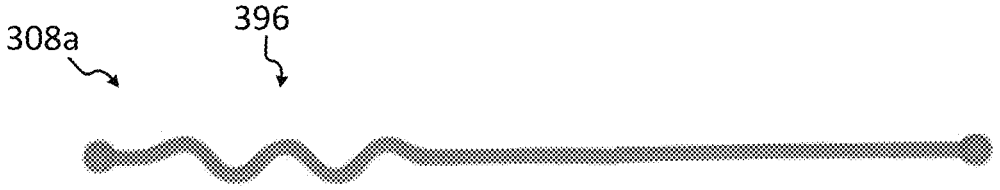
Figure 3C:
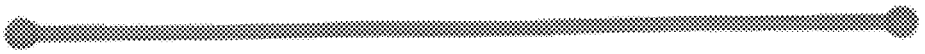

Turning now to FIGS. 3A-3C, additional details of exemplary tethers are illustrated and described. FIG. 3A illustrates an exemplary tether 307*a* having a first anchor end 352 and a second anchor end 354. Each of the anchor ends 352 and 354 includes a retention terminus 360 and 361, respectively, which, in some implementations, is generally spherical and characterized by retention-terminus diameter 369. As previously described, the retention-terminus diameter 369 is configured to interface with a bib aperture or utensil-retention aperture, via an interference or compression fit.

In some implementations, the material for the tether 307*a* is the same as the material of the bib and or eating utensils, though possibly with a different hardness. For example, in some implementations, the material for the bib and tether is a food-grade silicone having a Shore A durometer hardness of about 45 to about 65, or more preferably, of about 50 to about 60. The working ends of the eating utensils (e.g., working ends 242, as shown in FIGS. 2A, 2B and 2C), may be made of a food-grade silicone having a Shore A durometer hardness of about 55-90, or more preferably, of about 65-75. In other implementations, the working ends of the eating utensils may comprise a food-safe plastic, with the handles and retention ends comprising a silicone or softer plastic. In still other implementations, the eating utensils may be made of a food-safe plastic. In still other implementations, the working ends of the eating utensils may comprise a metal, with handles and retention ends comprising a silicone or plastic.

As shown in FIG. 3A, the tether 307*a* comprises a series of retention apertures 384*a*, 384*b* and 384*c*, each of which is characterized by a retention-aperture diameter 387. The retention terminus 361 and retention apertures 384*a*, 384*b* and 384*c* may also configured to interface with each other via an interference or compression fit. That is, the nominal diameter 387 of the retention apertures 384*a*, 384*b* and 384*c* may be smaller than the nominal diameter 369 of the retention terminus 361, but larger than a diameter 390 of a stem portion 393 of the tether 307*a*. The material of the tether 307*a* may be compressible, such that the retention terminus 361 can be compressed and/or the retention apertures 384*a*, 384*b* and 384*c* can be expanded, enabling a user of the tether 307*a* to form a loop using the retention end 360 of the tether 307*a* to secure a toy, cup or other utensil to the tether 307*a*.

In some implementations, the tether 307*a* comprises three retention apertures 384*a*, 384*b* and 384*c*, enabling a user to vary a size of the loop formed when the retention terminus 361 is secured in one of the retention apertures—e.g., a relatively smaller loop is formed when the retention terminus 361 is secured in the retention aperture 384*c*; and a relatively larger loop is formed when the retention terminus 361 is secured in the retention aperture 384*a*.

In some implementations, more or fewer retention apertures may be provided than shown in FIG. 3A. In some implementations, such as the tether 308*a* shown in FIG. 3B, additional retention apertures, like the apertures 384*a*, 384*b* and 384*c* that are integrated into the tether 307*a* itself, may be omitted altogether.

As shown in FIG. 3B, tether 308*a* comprises an elastic region 396 whose design may facilitate stretching of the tether 308*a* along its length. In some implementations, the material from which the tether 308*a* is made is elastic, such that the elastic region 396 stretches out when pulled but returns to its original state when a pulling or stretching force is removed. The entire tether 308*a* may stretch, including segments other than the elastic region 396; though the elastic section 396 may provide greater elasticity than the other portions.

In FIG. 3B, the elastic region 396 is depicted as a two-dimensional zigzag of the material of the tether 308*a* along a relatively two-dimensional plane. In contrast with a three-dimensional spring or helical structure, the depicted elastic region 396 may be less likely to become tangled when twisted around and used by a baby or young child. In addition, this structure may maintain its functionality stably over repeated use. Further, a two-dimensional zigzag design may facilitate easier manufacturing (e.g., through a single-step compression molding process) than other tether designs.

In some implementations, the elastic section 396 may comprise fewer zigzag sections (or none, as illustrated in FIG. 3C). By varying the length of the elastic section 396 (e.g., by varying the number of zigzags), a maximum length (or maximum length given a certain amount of force) can be set. For example, in some embodiments, the tether 308*a* is configured to not exceed 12 inches when subjected to five pounds of stretching force. Such design parameters may be set, in some embodiments, to meet governmental regulations, such as regulations designed to minimize choking or strangulation hazards. In some implementations, the length of segments other than the elastic section 396 may also be varied to provide an tether 308*a* that is longer or shorter or that facilitates the securing of smaller or larger objects.

Figure 4A:
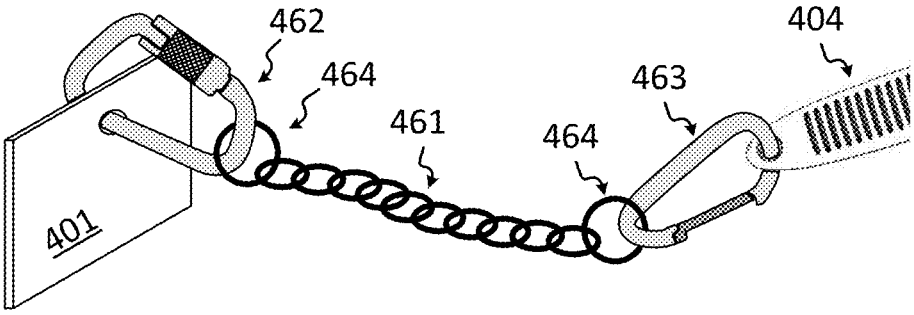
FIGS. 4A-4D depict various alternative ways of coupling a bib to a utensil.

Implementations in which compression or interference fittings are employed to couple a bib to a tether to an eating utensil (or other object) have been described; but other means for coupling a bib to eating utensils are also possible. That is, a bib may include a bib-coupling point that is configured to releasably engage a tether; and an eating utensil may include a utensil-coupling point that is configured to releasably engage a tether. For example, with reference to FIG. 4A, a bib 401 and utensil 404 may be coupled with a chain 461 and one or more carabiners, such as, for example, a locking (e.g., threaded) carabiner 462 or a spring-release carabiner 463. As shown, one or more rings 464 may couple the chain 461 to the carabiners 462 and 463.

Figure 4B:
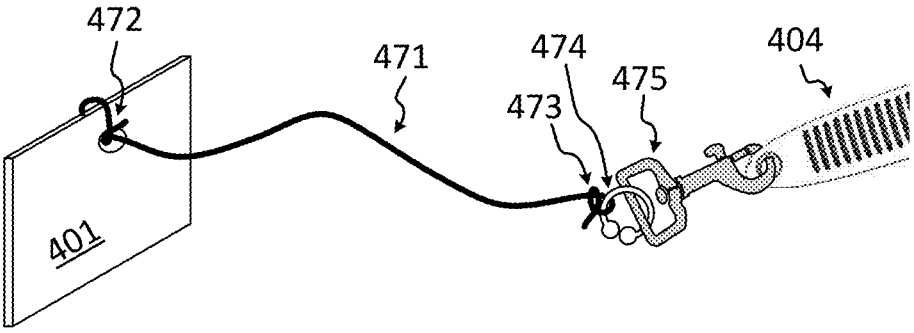

In other implementations, as illustrated in FIG. 4B, a lace 471 (or string or cord) may couple the bib 401 to a utensil 404—specifically, with a knot 472, or a knot 473 and one or more other coupling devices, such as, for example, an expandable ring 474 and/or quick-release clip 475.

Figure 4C:
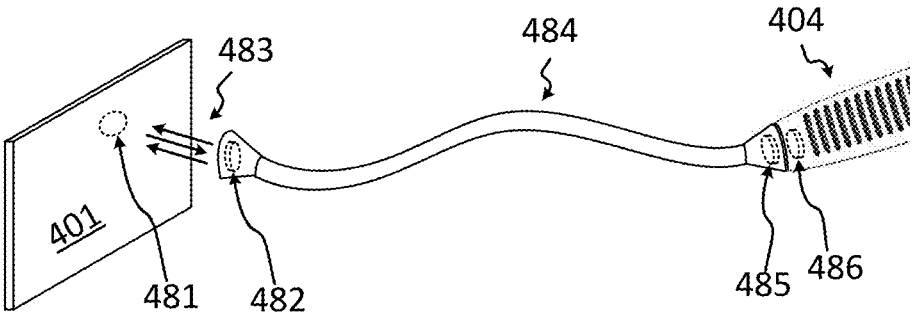

In other implementations, magnetic couplings may be employed. For example, with reference to FIG. 4C, a first magnet 481 may be disposed in the bib 401, and a second complementary magnet 482 (e.g., one that is polarized to create an attractive magnetic force 483 between the first magnet 481 and second magnet 482) may be disposed in the tether 484. Similarly, a third magnet 485 may be disposed in the opposite end of the tether 484, and a complementary fourth magnet 486 may be disposed in an eating utensil 404.

Figure 4D:
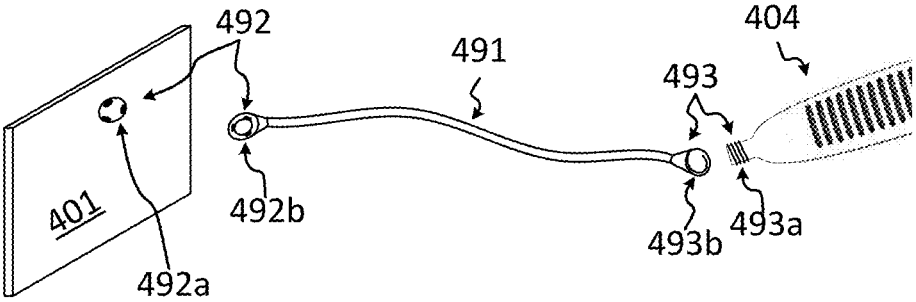

As another example, with reference to FIG. 4D, a bib 401 may be coupled to an eating utensil 404 with a tether 491 having a twist-lock connector 492 (e.g., one that comprises a receptacle portion 492*a* with locking blades and a post portion 492*b* with corresponding locking blades). A threaded connection 493 may also be employed (e.g., with a threaded post on the eating utensil 404 and a corresponding threaded receptacle 493*b* on the tether 491). In each of the foregoing examples, the various connection methods may be interchanged or combined in various ways, and different connection methods may be employed on different ends of a tether.

Several implementations have been described with reference to exemplary aspects, but it will be understood by those skilled in the art that various changes may be made and equivalents may be substituted for elements thereof without departing from the contemplated scope. For example, the bib may comprise any suitable material (e.g., one that is food-safe); the bib may include or omit a pocket or basin; in a tether that includes a retention terminus, that retention terminus may be generally spherical, or it may take another shape; utensils other than forks, spoons and knives may be provided in a kit—such as, for example, spatulas, ladles, tongs, chop sticks, markers, pens, or paintbrushes; toys may be provided with a kit or separate from a kit and may be configured to be coupled to a tether provided with the kit; a kit may include a single utensil or multiple utensils; a kit may include one tether, two tethers, or more; tethers and utensils may be provided separately from a bib; tethers may be elastic (e.g., stretchable), or they may resist stretching; tethers may have varying degrees of flexibility; a bib may include one bib aperture, two bib apertures, or some other number of bib apertures; the bib aperture(s) may be disposed on a basin or pocket (e.g., on a lip) if present, or the bib aperture(s) may be disposed on a main surface of the bib; coupling means may include chains, cords, links, carabiners, rings, quick-release clips, clasps, hooks, and catches.

Many other variations are possible, and modifications may be made to adapt a particular situation or material to the teachings provided herein without departing from the essential scope thereof. Therefore, it is intended that the scope include all aspects falling within the scope of the appended claims.

What is claimed is:

1. A kit comprising:

a bib having a protective surface; a basin disposed at a bottom end of the protective surface; and one or more bib apertures each characterized by a bib-aperture diameter;

at least one eating utensil having a working end; a retention end; and a handle disposed between the working end and the retention end; wherein the retention end includes a utensil-retention aperture characterized by a retention-aperture diameter; and a tether comprising a first anchor end and a second anchor end; wherein the first anchor end comprises a first retention terminus, and the second anchor end comprises a second retention terminus, each of the first and second retention termini comprising a compressible and resilient silicone having a Shore A durometer hardness of about 45 to about 65 and being characterized by a retention-terminus diameter that is, in a non-compressed state, greater than either the bib-aperture diameter or the utensil-retention-aperture diameter;

wherein the one or more bib apertures and first retention terminus are configured to enable the first retention terminus to be compressed and manipulated into and through one of the one or more bib apertures to releasably secure the tether to the bib with a compression fit, and wherein the utensil-retention aperture and second retention terminus are configured to enable the second retention terminus to be compressed and manipulated into and through the utensil-retention aperture to releasably secure the utensil to the tether with a compression fit.

2. The kit of claim 1, wherein the bib, the tether and the retention end comprise a food-grade silicone.

3. The kit of claim 1, wherein the bib further comprises a closure means for securing the bib around a neck of a wearer.

4. The kit of claim 1, wherein the bib further comprises a first cooperating wing and a second cooperating wing; wherein the first cooperating wing includes one or more buttons and the second cooperating wing includes one or more buttonholes; and wherein each of the one or more buttons is configured to releasably engage one of the one or more buttonholes to facilitate securing of the bib around a neck of a wearer.

5. The kit of claim 1, wherein the basin is configured to retain water and food items.

6. The kit of claim 1, wherein at least one of the one or more bib apertures is disposed on a lip of the basin.

7. The kit of claim 1, wherein the tether further comprises an elastic section between the first anchor end and second anchor end, the elastic section comprising a plurality of stretchable zigzags.

8. The kit of claim 1, wherein the handle comprises raised ridges configured to facilitate gripping of the handle.

9. The kit of claim 1, wherein the working end includes at least one of protrusions and ridges configured to stimulate gums, tongue or mouth of a user.

10. A kit comprising:

a bib having a protective surface and a bib-coupling aperture that is characterized by a bib-aperture diameter;

at least one eating utensil having a working end and a retention end; wherein the retention end includes a utensil-coupling aperture that is characterized by a utensil-aperture diameter; and a tether comprising a first anchor end and a second anchor end; wherein the first anchor end comprises a first coupling point that is configured to releasably couple to the bib-coupling aperture; and wherein the second anchor end comprises a second coupling point that is configured to releasably couple to the utensil-coupling aperture;

wherein the first coupling point comprises a first retention terminus, and the second coupling point comprises a second retention terminus, each of the first retention terminus and second retention terminus comprising a compressible and resilient silicone having a Shore A durometer hardness of about 45 to about 65 and being characterized by a retention-terminus diameter that is, in a non-compressed state, greater than either the bib-aperture diameter or the utensil-aperture diameter; and wherein the bib aperture and first retention terminus are configured to enable the first retention terminus to be compressed and manipulated into and through the bib aperture to releasably secure the tether to the bib with a compression fit, and wherein the utensil-retention aperture and second retention terminus are configured to enable the second retention terminus to be compressed and manipulated into and through the utensil-retention aperture to releasably secure the eating utensil to the tether with a compression fit.

11. The kit of claim 10, wherein the bib further comprises a basin disposed at a bottom end of the protective surface.

12. The kit of claim 10, wherein the bib-coupling point is disposed on a lip of the basin.

13. The kit of claim 10, wherein the at least one eating utensil comprises a fork, a spoon or a knife.

* * * * *